343-700 MS 6U 251 EX
9/8/87 08 4,692,769

United States Patent [19]
Gegan

[11] Patent Number: 4,692,769
[45] Date of Patent: Sep. 8, 1987

[54] DUAL BAND SLOTTED MICROSTRIP ANTENNA

[75] Inventor: Michael J. Gegan, Menlo Park, Calif.

[73] Assignee: The United States of America as represented by the Secretary of the Navy, Washington, D.C.

[21] Appl. No.: 856,569

[22] Filed: Apr. 14, 1986

[51] Int. Cl.[4] ..... H01Q 00/00
[52] U.S. Cl. ..... 343/700 MS; 343/770; 343/771
[58] Field of Search ..... 343/700 MS, 767, 770, 343/771

[56] References Cited

U.S. PATENT DOCUMENTS 3,577,196 5/1971 Pereda ..... 343/770
4,012,741 3/1977 Johnson ..... 343/700 MS
4,060,810 11/1977 Kerr et al. ..... 343/700
4,074,270 2/1978 Kaloi ..... 343/700
4,123,759 10/1978 Hines et al. ..... 343/854
4,138,684 2/1979 Kerr ..... 343/700 MS
4,356,492 10/1982 Kaloi ..... 343/700

*Primary Examiner*—Robert E. Wise
*Assistant Examiner*—Hoanganh Le
*Attorney, Agent, or Firm*—R. F. Beers; C. D. B. Curry; W. C. Daubenspeck

[57] ABSTRACT

A dual band microstrip antenna including a slotted microstrip radiating parallel to and spaced from a ground plane with dielectric material therebetween, the slotted microstrip radiating and having a first resonance corresponding to the dominant radiation mode that would occur in an unslotted microstrip and a second resonance created by the slot. The polarizations of the two resonances are perpendicular to each other with the slot resonance being polarized along the centerline of the slot.

14 Claims, 5 Drawing Figures

DUAL BAND SLOTTED MICROSTRIP ANTENNA

BACKGROUND OF THE INVENTION

This invention relates in general to low physical profile antennas and, in particular, to a dual band microstrip antenna employing a single coplanar feedline and a dual band microstrip radiating element.

A common dual-band (or multiple-band) design of microstrip antennas employs an antenna structure in which single-band microstrip radiating elements are stacked above a ground plane with the surface of each element dimensioned so as to resonate at a different frequency. Each of the radiating elements is fed with a separate feedline, either a coplanar feedline or a coaxial-to-microstrip adapter normal to the plane of the radiating element. The multiple layers and the multiple feedlines result in a less compact and more complex structure than is desirable for some aerospace applications.

Dual band operation using microstrip antennas and feed networks etched on the same surface have been constructed. U.S. Pat. No. 4,356,492 discloses a dual band antenna in which two single-band coplanar radiating elements are fed from a common coplanar input point.

Instantaneous dual band operation using single element microstrip antennas and feednetworks etched on the same surface require either (1) microstrip antennas with a single feedline on the same surface as the antenna (coplanar antenna) or (2) diplexed output ports on the feed network. Dual band, coplanar, single feedline antenna designs are available only if the frequencies of interest are within 15 percent of each other or are harmonically related. Diplexers in the feed network result in a larger, less efficient, and more complex microstrip antenna array.

SUMMARY OF THE INVENTION

It is therefore an object of the present invention to provide a dual band, low profile antenna capable of operating at widely spaced frequencies.

Another object is to provide a compact, efficient, dual band microstrip antenna capable of operating at widely spaced frequencies without the use of stacked radiating elements or diplexers in the feed network.

Another object is to provide a dual band microstrip antenna or antenna array employing dual frequency radiating elements with a single coplanar feedline capable of operating at widely spaced frequencies.

These objects are provided by a microstrip antenna employing a dual frequency slotted radiating element and having a single coplanar feedline. The illustrated embodiment is a slotted microstrip disc radiating element in which the first resonance corresponds to the dominant radiation mode that would occur in an unslotted microstrip disc element. By introducing a slot of appropriate size and location, a second resonance is created. The polarizations of the two resonances are perpendicular to each other with the slot resonance being polarized along the centerline of the slot. The principle of using a slot for creating an additional radiating microstrip resonance that is polarized perpendicular to the normal radiating microstrip resonance can be applied to rectangular microstrip antennas as well.

Other objects and many of the attendant advantages will be readily appreciated as the present invention becomes better understood by reference to the following detailed description when considered in conjunction with the accompanying drawings wherein:

DESCRIPTION OF THE PREFERRED EMBODIMENT

Figure 1:
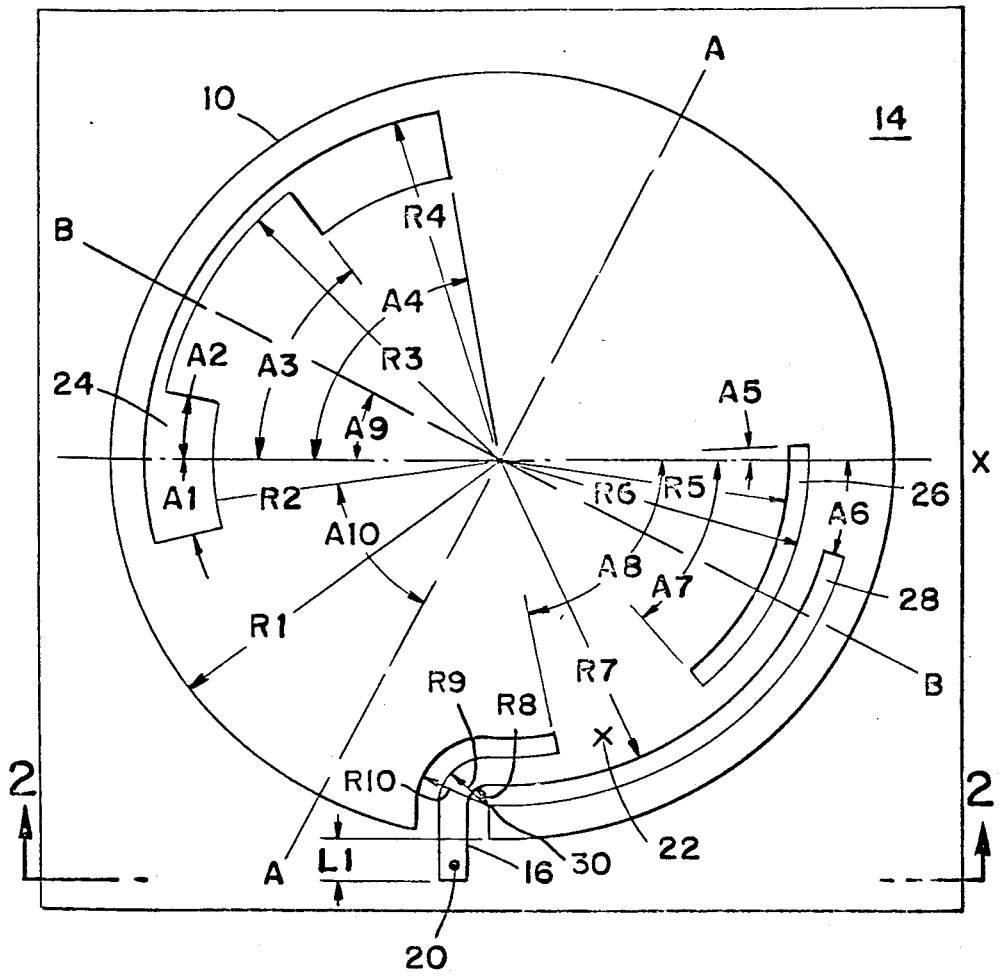
FIG. 1 is a plan view of a dual band slotted microstrip antenna according to the present invention employing slotted disc radiating elements.
Figure 2:
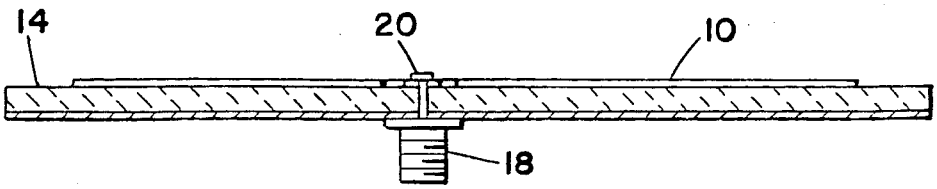
FIG. 2 is a cross-sectional view of dual band antenna illustrated in FIG. 1 taken along line 2—2 in FIG. 1.

Referring now to the drawings, FIGS. 1 and 2 illustrate a preferred embodiment of a dual band microstrip antenna according to the present invention. The coplanar slotted disc microstrip antenna thereshown has two resonances of similar bandwidth. These resonances are designated as resonance A and resonance B. Resonance A is polarized along line A—A and resonance B is polarized along line B—B.

The antenna comprises a disc radiating element 10 separated from a ground plane 12 by a dielectric substrate 14. The disc 10 has a radius R1. The disc 10 is fed by a single coplanar microstrip transmission line 16 which provides a quarter wave transformer for coupling both frequency bands to the disc. The microstrip transmission line 16 is fed at the two frequency bands from a coaxial-to microstrip adaptor 18 having a center probe 20.

A coplanar microstrip disc antenna (unslotted) has a dominant radiation mode that is polarized along the line passing through the effective feedpoint 22 and the center of the disc. The frequency of this resonance is determined by the radius of the disc. Resonance A, also referred to as the disc resonance, corresponds to the dominant radiation mode that would occur in a microstrip disc element having radius R1.

In the dual band coplanar microstrip antenna, the disc radiating element 10 has a slot 24 which creates an additional resonance, resonance B, which is polarized along the slot centerline B—B. Resonance B is also referred to as the slot resonance. The curved slot 24 is defined by angles A1, A2, A3 and A4 with respect to the X-axis, inner radii R2 and R3, and outer radius R4. The slot 24 is located in an area away from the main current path of the disc's dominant mode, resonance A, to prevent degradation of resonance A. The frequency of the slot resonance B is primarily controlled by the slot length. The expanded apertures defined by the inner raduis R2 at the ends of slot 24 are primarily for impedance matching although they do have a limited effect on the frequency of resonance B. The use of two expanded apertures at the ends of the slot 24 separated by a narrow center section lowers the impedance at the slot resonance to approximately the same value as the disc 10 to the disc resonance so that the quarter wave transformer must only match a single impedance for both resonances. The slot 24 must be of sufficient arc length along outer radius R4 to support the additional microstrip radiation mode B. The slot 24 lowers the frequency of the disc resonance A and also shifts the polarization of the disc resonance A to an orientation along line A—A which is normal to line B—B, the polarization of the slot resonance B.

The preferred embodiment is also provided with additional curved slots 26 and 28 which serve to tune the input impedance of the slotted disc element 10 at resonances A and B. Slot 26 is defined by angles A5 and A7 with respect to the X-axis, and inner radius R5 and outer radius R6. Slot 28 extends from the input feed line 16 to angle A6 with respect to the X-axis, and has inner radius R7. The radial dimensions R3, R4, and R7 of the main slot 24 and the outer impedance tuning slot 28 affect the frequency of resonance B to a greater extent than the angular dimensions A5, A6 and A7 of the impedance tuning slots 26 and 28.

The angular location of slot 26, defined by the dimension A5 and A7, and the angular location slot 28, defined by dimension A6, provide fine-tuning adjustments to the input impedance of the slotted disc 10 at resonances A and B. The arc length and angular location of the primary slot 24, defined by dimensions A1 and A4, can be used as fine tuning adjustments to the input impedance of the radiating element at resonance B.

Course adjustment of the input impedance of the slotted disc 10 at both resonance A and resonance B may be provided by adjusting the location of the end of the feedline 16, dimension A8. The gap distance of the primary slot 24, the distance defined by outer radius R4 minus inner radius R3, also provides a course adjustment to the input impedance of the slotted disc 10 at resonance B.

A dual band slotted disc microstrip antenna as illustrated in FIG. 1 has been constructed for operation at 1380 MHz and 1557 MHz. The dimensions of this operational embodiment are given in Table 1. These dimensions are based on a 0.125 inch thick teflon/fiberglass substrate having a dielectric constant of 2.55 and a dissipation factor less than 0.002. The angles A9 and A10 define the orientation of the resonances A and B as shown in FIG. 1. Dimensions R8, R9, and R10 about point 30 and dimension L1 from the beginning of the coplanar microstrip feedline 16 to the outer edge of the disc 10 define the quarter wave transformer.

| Dimensions in Inches | Angles in Degrees |
|---|---|
| R1 = 1.507 | A1 = 14.7 |
| R2 = 1.148 | A2 = 12.7 |
| R3 = 1.380 | A3 = 54.9 |
| R4 = 1.410 | A4 = 82.3 |
| R5 = 1.117 | A5 = 02.2 |
| R6 = 1.201 | A6 = 17.8 |
| R7 = 1.326 | A7 = 51.4 |
| R8 = 0.084 | A8 = 79.4 |
| R9 = 0.209 | A9 = 33.8 |
| R10 = 0.293 | A10 = 56.2 |
| L1 = 0.564 | |

Figure 3:
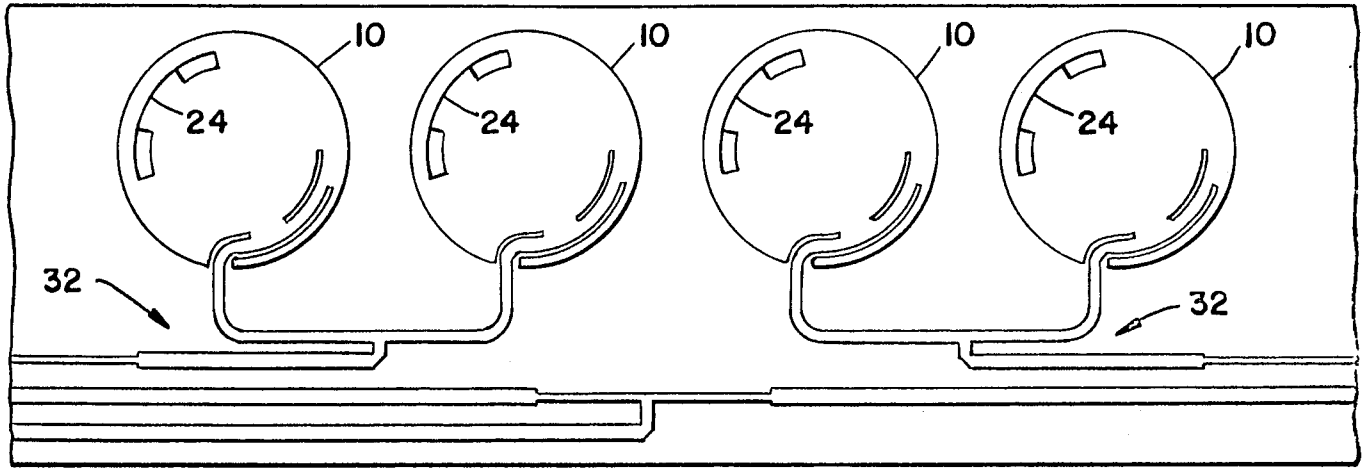
FIG. 3 illustrates a dual band array antenna employing the dual band slotted disc elements.

FIG. 3 illustrates that the dual frequency band microstrip disc element 10 of FIG. 1 can be incorporated as a microstrip element in a microstrip antenna array in which the microstrip feed network 32 and the microstrip element are etched on to the same copper surface concurrently.

Figure 5:
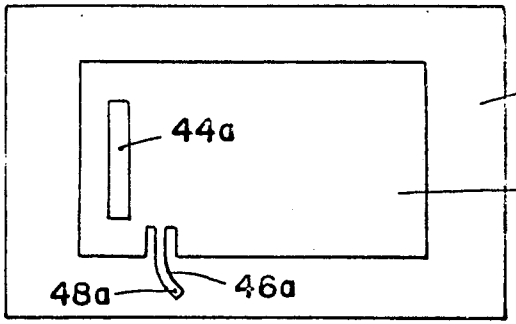
FIGS. 4 and 5 are plan views illustrating dual band rectangular radiating elements according to the present invention.
Figure 4:
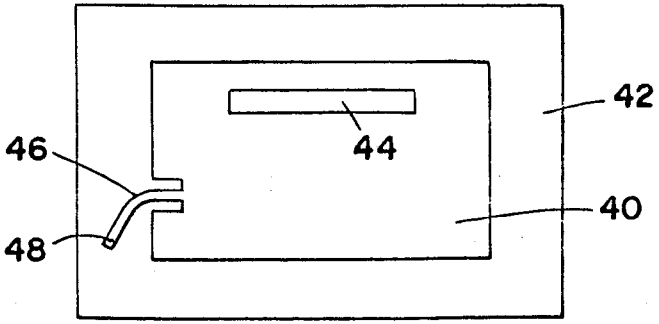

FIGS. 4 and 5 illustrate that the principle of using a slot for creating an additional efficient radiating microstrip resonance that is polarized perpendicular to the normal radiating microstrip resonance can be applied to rectangular microstrip elements as well as disc elements. FIG. 4 illustrates a rectangular microstrip element 40 having a slot 44 on a dielectric substrate 42. The rectangular element is fed by a coplanar microwave transmission line 46 from coaxial to microstrip adaptor 48 to provide a primarly resonance polarized along line the longer dimension of the element and a slot resonance polarized along the shorter dimension of the element. FIG. 5 illustrates a rectangular element **40*a* in which the slot 44*a* and the coplanar microwave feedline 46*a*** are disposed to provide a primary resonance along the shorter dimension of the element and the slot resonance along the longer dimension of the element.

Thus it can be seen that the present invention provides a dual band microstrip antenna having a single coplanar microstrip feedline. The bandwidth at each frequency is comparable to that for a single band antenna of the same thickness and substrate. The two frequencies can be separated by as much as a 2:1 ratio or as close tgether as necessary to make a stagger-tunes antenna for increased bandwidth. The frequencies of interest need not be within 15 percent of each other or harmonically related. The antenna can be incorporated as a microstrip element in a microstrip antenna array. No diplexers are necessary for interconnection with a microstrip feed network. The antenna provides a smaller, more efficient, and less complex microstrip antenna.

Obviously, many modifications and variations of the present invention are possible in light of the above teachings. It is therefore to be understood that within the scope of the appended claims, the invention may be practiced otherwise than as described.

What is claimed and desired to be secured by Letters Patent of the United States is:

1. A dual-band microstrip antenna comprising:

(a) a thin dielectric substrate;

(b) a thin conductive layer disposed on one surface of said substrate, said conductive layer forming a ground plane;

(c) a thin conductive slotted radiating element disposed on the other surface of said substrate, said radiating element having a first resonance corresponding to the dominant radiation mode that would occur in an unslotted radiating element otherwise identical to the slotted radiating element, said radiating element having a first slot disposed in an area of the radiating element away from the main current path of the radiating element's dominant mode, said radiating element having a second resonance created by said first slot; and (d) a single microstrip feedline for coupling radio frequency signals to said slotted radiating element, said single feedline being coplanar with said slotted radiating element.

2. A dual-band microstrip antenna as recited in claim 1 wherein said slotted radiating element comprises:

(a) a disc radiating element of radius R1, the first resonance corresponding to the dominant radiation mode that would occur in a microstrip disc radiating element having radius R1, (b) said disc radiating element having a first slot disposed in an area of the disc away from the main current path of the disc's dominant radiation mode, said first slot having sufficient length to support said second resonance.

3. A dual-band microstrip antenna as recited in claim 2 wherein said single microstrip feedline provides a quarter wave transformer for coupling said first and second resonances to said disc.

4. A dual-band microstrip antenna as recited in claim 2 wherein said first slot has a narrow center section and expands inwardly at its ends.

5. A dual-band microstrip antenna as recited in claim 2 wherein said disc has at least one additional slot disposed radially opposite from said first slot to tune the input impedance of the disc.

6. A dual-band microstrip antenna as recited in claim 1 wherein said slotted radiating element comprises:

(a) a disc radiating element of radius R1, the first resonance corresponding to the dominant radiation mode that would occur in a microstrip disc radiating element having radius R1, (b) said disc radiating element having a first curved slot disposed in an area of the disc away from the main current path of the disc's dominant radiation mode, said first curved slot having sufficient length to support said second resonance.

7. A dual-band microstrip antenna as recited in claim 6 wherein said first slot has a narrow center section and expands inwardly at its ends.

8. A dual-band microstrip antenna as recited in claim 6 wherein said disc has at least one additional curved slot disposed radially opposite from said first curved slot to tune the input impedance of the disc.

9. A dual-band microstrip antenna as recited in claim 1 wherein said single microstrip feedline provides a quarter wave transformer for coupling said first and second resonances to said disc.

10. A dual-band microstrip antenna as recited in claim 1 wherein said first slot has a narrow center section and expands inwardly at its ends.

11. A dual-band microstrip antenna as recited in claim 1 wherein said slotted radiating element has at least one additional slot disposed oppositely from said first slot to tune the input impedance of the radiating element.

12. A dual-band microstrip antenna as recited in claim 1 wherein said slotted radiating element comprises:

(a) a rectangular radiating element having a first resonance corresponding to the dominant radiation mode that would occur in an unslotted rectangular radiating element otherwise identical to the slotted radiating element, said rectangular radiating element having a first slot disposed away from the main current path of the radiating element's dominant mode, said radiating element having a second resonance created by said first slot.

13. A dual-band microstrip antenna comprising:

(a) a thin dielectric substrate;

(b) a thin conductive layer disposed on one surface of said substrate, said conductive layer forming a ground plane;

(c) a plurality thin conductive slotted radiating elements disposed in an array on the other surface of said substrate, each of said radiating elements having a first resonance corresponding to the dominant radiation mode that would occur in an unslotted radiating element otherwise identical to the slotted radiating element, each of said radiating elements having a first slot disposed in an area of the radiating element away from the main current path of the radiating element's dominant mode, each of said radiating elements having a second resonance created by said first slot; and (d) a microstrip feed network for coupling radio frequency signals to said slotted radiating elements, each of said plurality of microstrip elements being fed by a single feedline, said single feedline being coplanar with said slotted radiating element.

14. A dual-band microstrip antenna as recited in claim 13 wherein each of said slotted radiating elements comprises:

(a) a disc radiating element of radius R1, the first resonance corresponding to the dominant radiation mode that would occur in a microstrip disc radiating element having radius R1, (b) said disc radiating element having a first slot disposed in an area of the disc away from the main current path of the disc's dominant radiation mode, said first slot having sufficient length to support said second resonance.

* * * * *